US006814641B2

(12) United States Patent
Tagawa

(10) Patent No.: US 6,814,641 B2
(45) Date of Patent: Nov. 9, 2004

(54) METHOD OF MANUFACTURING DISCHARGE LAMPS AND A DISCHARGE LAMP WITH A HALOGEN INTRODUCTION CARRIER

(75) Inventor: Yukiharu Tagawa, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 190 days.

(21) Appl. No.: 09/864,219

(22) Filed: May 25, 2001

(65) Prior Publication Data

US 2001/0050535 A1 Dec. 13, 2001

(30) Foreign Application Priority Data

May 26, 2000 (JP) ..... 2000-156063

(51) Int. Cl.[7] ..... H01J 9/38; H01J 9/395
(52) U.S. Cl. ..... 445/9; 445/16; 445/17
(58) Field of Search ..... 445/9, 16, 17

(56) References Cited

U.S. PATENT DOCUMENTS

| | | | | |
|---|---|---|---|---|
| 3,957,328 A | * | 5/1976 | VAN DER Wolf et al. | 445/9 |
| 3,983,440 A | * | 9/1976 | Scott et al. | 313/566 |
| 4,275,330 A | * | 6/1981 | Cho et al. | 313/630 |
| 4,487,589 A | * | 12/1984 | Mishra et al. | 445/51 |
| 4,557,700 A | * | 12/1985 | Rothwell et al. | 445/53 |
| 4,808,136 A | * | 2/1989 | Schuster | 445/9 |
| 5,109,181 A | | 4/1992 | Fischer et al. | |
| 5,374,871 A | * | 12/1994 | Johnson | 313/546 |
| 5,497,049 A | | 3/1996 | Fischer | |
| 5,876,205 A | | 3/1999 | Schiabel et al. | |
| 5,905,341 A | * | 5/1999 | Ikeuchi et al. | 313/639 |
| 6,060,830 A | * | 5/2000 | Sugitani et al. | 313/639 |

FOREIGN PATENT DOCUMENTS

| | | |
|---|---|---|
| EP | 0 479 259 | 4/1992 |
| EP | 0 949 657 A2 | 10/1999 |
| GB | 1 423 981 | 2/1976 |
| WO | WO 00/19488 | 4/2000 |

OTHER PUBLICATIONS

Examiner: Martin Vincente, M, European Search Report, Date of Search: Aug. 14, 2001, Place of Search: The Hague.
The Free Dictionary.com/sintered, One Page.
The Free Dictionary.com/sinter, One Page.
The Free Dictionary.com/adsorption, One Page.
Wikipedia, The Free Encyclopedia, wikipedia.org/wiki/mercury(element), Six Pages.
Hawley's Condensed Chemical Dictionary, Fourteenth Edition, p. 708.

* cited by examiner

*Primary Examiner*—Vip Patel
*Assistant Examiner*—Anthony Perry
(74) *Attorney, Agent, or Firm*—Nixon Peabody LLP; David S. Safran

(57) ABSTRACT

A discharge lamp manufacturing method that provides control of the introduction of a predetermined amount of halogen, unaccompanied by carbon or hydrogen, into a discharge vessel of the lamp so that a discharge lamp having an adequate operating pressure and that can maintain enhanced lighting conditions over a long period can be achieved. In particular, a halogen-introduction carrier is used in the manufacture of the discharge lamp for introducing a predetermined amount of metal halide. The discharge lamp manufacturing method includes a device for introducing halogen into the discharge vessel and includes heating a halogen-introduction carrier composed of a porous body containing metal halides.

6 Claims, 2 Drawing Sheets

METHOD OF MANUFACTURING DISCHARGE LAMPS AND A DISCHARGE LAMP WITH A HALOGEN INTRODUCTION CARRIER

BACKGROUND OF THE INVENTION

1. Field of the Invention

The present invention is directed generally to a method of manufacturing discharge lamps, and a discharge lamp including a halogen-introduction carrier.

2. Description of Related Art

High-pressure mercury lamps having a very high mercury vapor pressure when lighted, such as 200 bar (approximately 197 atmospheres), have been used recently as discharge lamps for such applications as backlight for projection-type liquid crystal display equipment instead of metal halide lamps. (See, U.S. Pat. No. 5,109,181 and U.S. Pat. No. 5,497,049.)

U.S. Pat. No. 5,109,181 is directed to a high-pressure mercury lamp including tungsten discharge electrodes mounted in a discharge vessel within which are sealed a rare gas, such as mercury in the amount of at least 0.2 mg/mm$^3$, and a halogen in the amount of $1\times10^{-6}$ to $1\times10^{-4}$ $\mu$mol/mm$^3$, and which operates with a tube wall load of 1 W/mm$^2$. In this high-pressure mercury lamp, the reason for including a halogen is to prevent darkening of the tube wall of the discharge vessel. A method of introducing the halogen bromine in the form of methylene bromide ($CH_2Br_2$) is described as the method for incorporation of the halogen in the high-pressure mercury lamp.

When halogen is sealed into the discharge vessel in the form of methylene bromide, however, carbon and hydrogen are also introduced into the discharge vessel. Accordingly, if the amount of methylene bromide introduced is increased in order to incorporate the large amount of halogen needed in the resultant high-pressure mercury lamp, larger amounts of carbon and hydrogen will be introduced as well. As a result, the resulting high-pressure mercury lamp is liable to phenomena such as loss of transparency due to darkening or frosting of the tube wall of the discharge vessel arising from the carbon and hydrogen.

In manufacturing the high-pressure mercury lamp described above, after the airtight seal portion on one side of the quartz glass tube that serves as the discharge vessel is formed, methylene bromide is introduced through a forked gas introduction tube, after which the other air-tight seal portion is formed. During the manufacture of that high-pressure mercury lamp, accurate control of the amount of halogen incorporated is very difficult, since the methylene bromide is a gas and it is necessary to control the working temperature.

Another known means of incorporating the halogen is to introduce a metal halide in the form of a pellet. This method is conventionally used in the manufacture of metal halide lamps. In very high-pressure mercury lamps that have been used as light sources for liquid crystal projectors in recent years, the volume of the discharge space formed by the discharge vessel has been small, no more than 80 mm$^3$, in order to raise the working voltage when lighted; the amount of halogen necessary to prevent blacking of the tube wall of the discharge vessel in this case is 3 $\mu$g or less in weight. Because even the smallest of the generally available pellets are 20 $\mu$g in weight, an excessive amount of halogen is incorporated into the discharge vessel. As a result, the halogen causes wastage of the discharge electrodes, and the undesirable phenomenon of light-spot shift.

The technology of introducing mercury halide into the discharge vessel by means of vapor deposition on some structural elements of the lamp has been presented in published European Patent Application EP 0949657 as another method of incorporating halogen. More specifically, halogen is introduced into the discharge vessel via vapor deposition of mercury halide on the metal electrodes. Compared with the two methods described above, this method is superior in that it is possible to incorporate a small amount of halogen without introducing hydrogen and carbon as well. However, it is difficult to control the amount of halogen applied by vapor deposition, and thus, there is wide variation of the amount of halogen incorporated. In the conventional methods, as stated above, it is difficult to accurately introduce a very small amount of halogen without causing damage to the discharge vessel.

SUMMARY OF THE INVENTION

The present invention has been developed to overcome at least the aforementioned prior art problems. Thus, an object of the present invention is to provide a manufacturing method for discharge lamps that is capable of regulating accurately very small amounts of halogen, unaccompanied by carbon and hydrogen in a discharge vessel, and that is capable of introducing the halogen using a very easy operation.

A second object of the present invention is to provide a discharge lamp that has an adequate working pressure, and maintains good lighting conditions for extending periods in comparison to conventional devices.

A third object of the present invention is to provide a halogen-introduction carrier that can handle accurate amounts of metal halides even in minute quantities.

These and other objects are solved by providing a method of manufacturing discharge lamps in which a halogen is sealed in a discharge vessel including a main tube that forms a light emitting discharge space and auxiliary tubes connected thereto, and whereby halogen is introduced into the discharge vessel by heating a halogen-introduction carrier including a porous body containing metal halides. In the aforementioned method of manufacturing discharge lamps, the halogen-introduction carrier is preferably positioned inside the discharge vessel and can be heated from an outside source. Preferably, it is desirable that the halogen-introduction carrier is reusable after releasing all of the metal halides. It is also desirable that the metal halide be composed of at least one of bromine, chlorine, iodine and mercury, and that the halogen-introduction carrier be a porous body of tungsten.

The discharge lamp of the present invention includes a light emitting discharge space having a volume which is preferably no greater than 80 mm$^3$ and the predetermined amount of halogen is between $1.7\times10^{-4}$ $\mu$mol/mm$^3$ and $6.7\times10^{-4}$ $\mu$mol/mm$^3$. In addition, in the discharge lamp in accordance with the present invention, halogen is sealed in the discharge vessel, and the halogen-introduction carrier is located within the discharge vessel. The halogen-introduction carrier of the present invention can be a porous tungsten body of which the density of tungsten metal is 40% to 70%.

According to the method of manufacturing discharge lamps described above, the halogen is introduced via a halogen-introduction carrier that is preferably a porous body in which a metal halide is absorbed in a roughly unimolecular layer. For that reason, it is possible to control the target amount of halogen to be introduced, even when the amount is very low, by controlling the amount of the halogen-introduction carrier used for introduction. Moreover, the operation of introducing the predetermined amount of halogen is very easy. And since the halogen is introduced via a metal halide, there is no possibility that carbon or hydrogen will be introduced into the discharge vessel.

In the discharge lamp of the present invention, the desired amount of halogen is sealed into a discharge vessel that has a discharge space of small volume. It is possible, therefore, to obtain accurately the target luminous flux maintenance ratio, and to prevent the occurrence of undesirable phenomena such as light-spot shift due to wastage of the discharge electrodes that arise from an excessive amount of halogen. Advantageously, no hydrogen or carbon is introduced into the discharge vessel, and thus, there is no darkening or loss of transparency of the discharge vessel tube wall.

Preferably, the halogen-introduction carrier of the present invention is a porous body of tungsten, has a relatively great specific surface, and can absorb metal halides in a roughly unimolecular layer. For that reason, it is possible to control the target amount of halogen to be introduced, even when the amount is very slight, by controlling the amount of the halogen-introduction carrier used.

DETAILED DESCRIPTION OF THE PREFERRED EMBODIMENTS

Figure 1:
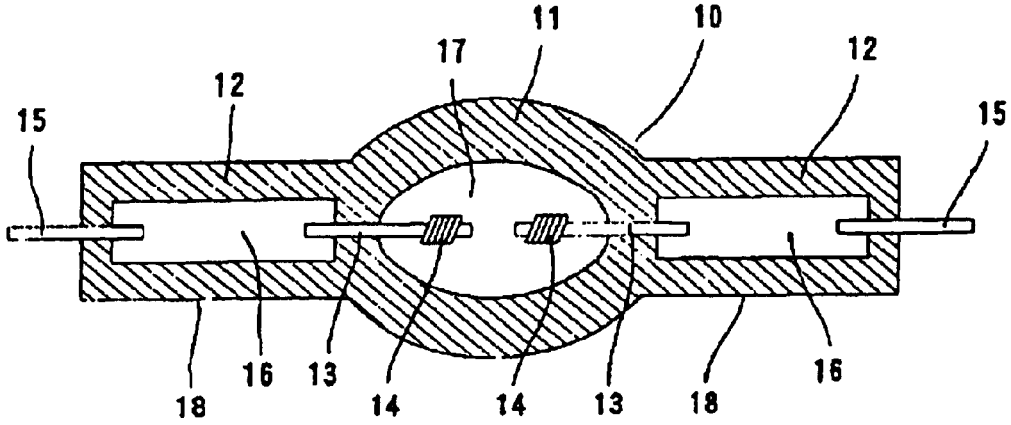
FIG. 1 is a cross-sectional view showing the structure of a high-pressure mercury lamp in accordance with a first embodiment of the present invention.

FIG. 1 shows a high-pressure mercury lamp having a discharge vessel 10 that includes an elliptical-shaped luminescent tube 11 and elongated seal portions 12 that extend on both sides of the tube 11 outwardly along the tube axis. A metallic foil 16 of molybdenum is sealed air-tight within the seal portions 12 to form an air-tight seal 18. A pair of tungsten discharge electrodes 14 formed at the tips of electrode bars 13 that extend along the tube axis from the inner ends of the metallic foils 16 face each other across the discharge space that is surrounded by the luminescent tube 11. External lead bars 15 are electrically connected to the electrode bar 13 through the metallic foil 16.

In the discharge lamp, the volume of the light emitting discharge space 17 is preferably no greater than 80 $mm^3$. A halogen is hermetically sealed within the discharge vessel 10 in predetermined amount between $1.7\times10^{-4}$ $\mu mol/mm^3$ and $6.7\times10^{-4}$ $\mu mol/mm^3$. An amount of halogen less than $1.7\times10^{-4}$ $\mu mol/mm^3$ is inadequate to maintain the halogen cycle, and will not be possible to obtain a good luminescent flux maintenance ratio, while an amount of halogen greater than $6.7\times10^{-4}$ $\mu mol/mm^3$, wastage of the discharge electrodes 14 will be great and the luminescent flux maintenance ratio will decline quickly because of the occurrence of light-spot shift. Preferably, the discharge space is filled with a halogen, such as at least one of bromine, chlorine and iodine is used as the halogen, in combination with mercury and a rare gas, each in a suitable quantity. The amount of mercury incorporated is at least 0.15 $mg/mm^3$ so as to make it possible to produce light suitable as a backlight for liquid crystal projection equipment.

Figure 2:
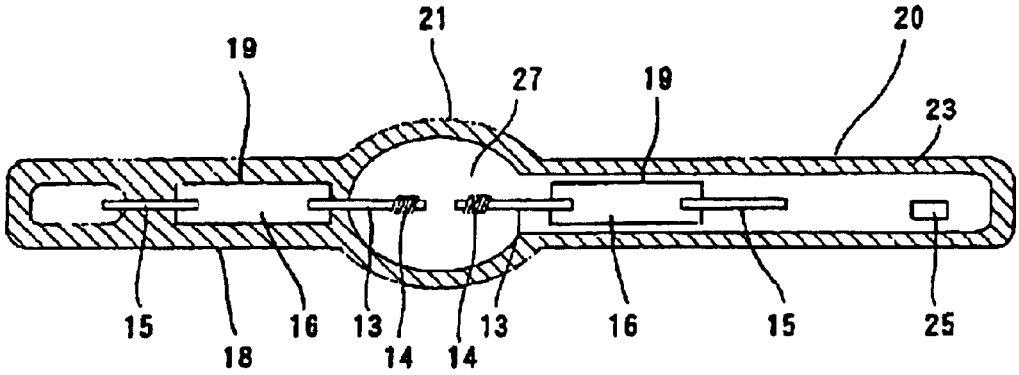
FIG. 2 is a cross-sectional view showing the electrode assembly inserted in the seal tube.

As shown in FIG. 2, in the method for producing a discharge lamp, a discharge vessel including an elliptical luminescent tube 21 and elongated seal portions 20 that extend outwardly along the tube axis on both sides, two electrode assemblies 19 are inserted into and held within the seal tube 20 that has a main tube 21 and an auxiliary tube 23 connected as a seal tube extended from one side of the main tube. In the electrode assembly 19, one side of a metallic foil 16 is attached to the back end of the electrode bar 13 that has a discharge electrode 14 formed on its tip, and the other end of the metallic foil 16 is connected to the tip of the external lead bar 15.

Moreover, each of the electrode assemblies 19 is positioned such that within the seal tube 20, the discharge electrodes 14 face each other within the discharge space 27, and the metallic foils 16, 16 are positioned in the seal tubes of the main tube 21. In the other side of the seal tube 20, an air-tight seal is formed where a metallic foil 16 of one side of the electrode assembly 19 is located. In addition, a halogen-introduction carrier 25, which is preferably a porous body of controlled size which has absorbed a metal halide, is placed within the auxiliary tube 23 of the seal tube 20. Thereafter, substances such as a rare gas are incorporated within this seal tube in the desired amounts.

Figure 3:
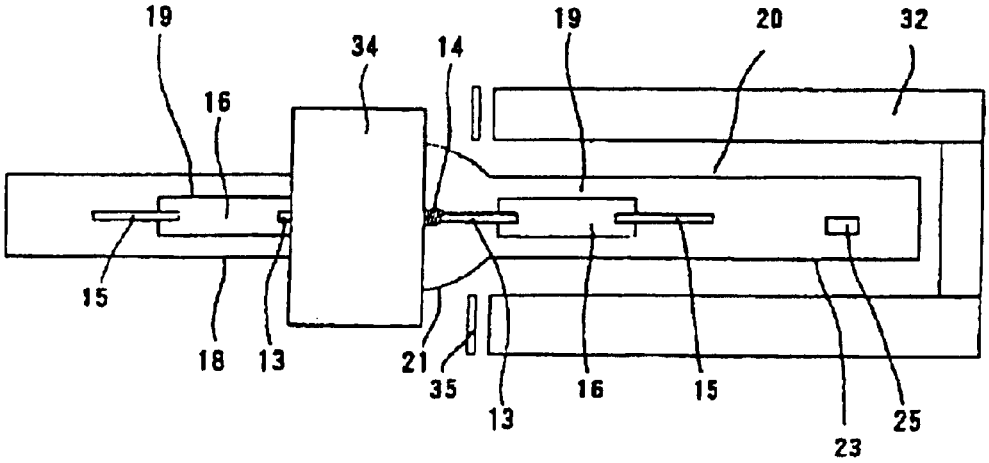
FIG. 3 is a top view showing the heating of the seal tube.

Next, as shown in FIG. 3, the auxiliary tube 23 and the part of the seal tube 20 that connects to it are inserted in an electric furnace 32 whereby the electric furnace 32 heats them for preferably five to twenty minutes at between 500 to 1,000° C. At that time, the portion of the main tube 21 that will be the luminescent tube is protected from the heat of the electrical furnace 32 by a heat shield 35. Those portions are also cooled by a cooling jig 34 that is placed over them. The heating of the seal tube 20 should be done under conditions adequate to release the halogen from the halogen-introduction carrier 25 that is in place within the auxiliary tube 23 of the seal tube 20. For example, a burner can be placed around the outer periphery of the auxiliary tube 23. When the halogen-introduction carrier 25 that has been placed within the auxiliary tube 23 of the seal tube 20 is heated from outside the auxiliary tube 23 in this way, the metal halide becomes a gas and is released from the halogen-introduction carrier 25; it expands into the space 27 that will be the discharge space, and is introduced into the main tube 21 which is at a low temperature.

Once the seal tube 20 is removed from the electric furnace 32 and also released from the cooling jig 34, the seal tube 20 is sealed at the location of the metallic foil 16 of the electrode assembly 19 on the side connected to the auxiliary tube 23, thereby forming an airtight seal 18. Afterwards, the auxiliary tube 23 on the one side of the seal tube 20 is removed, completing the manufacture of a high-pressure mercury lamp as shown in FIG. 1. The halogen-introduction carrier 25 is recovered at the same time. In this process, materials such as a high-melting-point metal porous body and a ceramic porous body can be used as the halogen-introduction carrier 25. For example, such materials such as at least one of a porous body of tungsten, a porous body of aluminum oxide ($Al_2O_3$) and a porous body of silicon oxide ($SiO_2$) converted to cristobalite can be used, but it is particularly desirable to use a porous body of tungsten.

As a result, in a halogen-introduction carrier that comprises a tungsten porous body, a tungsten metal density of between 40% to 70%, and particularly from between 40% to 65%, is desirable in that it has a relatively large specific surface and is easily worked. Incidentally, the density of metallic tungsten is 19.7 g/cm$^3$, and thus, it is desirable that the density of a halogen-introduction carrier 25 which is a porous body is from 8 to 13 g/cm$^3$. Any metal halide that is released by heating can be used as the metal halide absorbed by the halogen-introduction carrier 25. Specifically, compounds of bromine and mercury, compounds of chlorine and mercury and compounds of iodine and mercury can be used, and mercury bromide ($HgBr_2$), a compound of bromine and mercury, is particularly desirable. The halogen-introduction carrier 25 can be produced by mixing powdered tungsten with a binder such as stearic acid filling a mold with columnar mold spaces, and applying pressure with a press. By heating the molded product under a hydrogen atmosphere, it is possible to eliminate a binder and obtain a pre-sinter. The pre-sinter thus obtained is sintered by heating in a vacuum, thereby producing a porous body as the halogen-introduction carrier 25.

Figure 4:
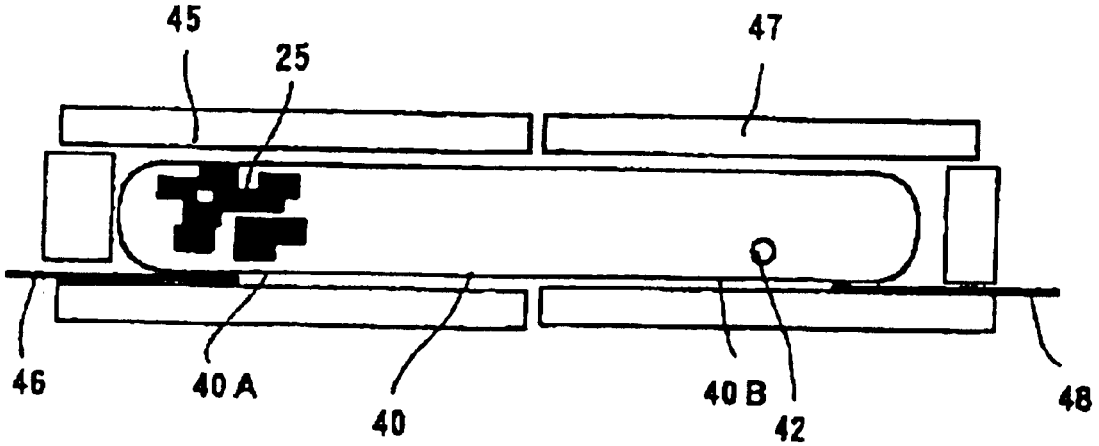
FIG. 4 is a side view showing the heating of the seal body with the pellet and halogen-introduction carrier located inside.

As shown in FIG. 4, after the halogen-introduction carrier 25 has been cleaned by an appropriate method, a number of halogen-introduction carriers 25 are placed in one end of a seal body 40 under a vacuum or a reduced pressure, non-oxidizing gas. The seal body 40 is inserted in an electric furnace 45 that has a thermocouple 46 at the end 40A where the halogen-introduction carriers 25 are, and in an electric furnace 47 that has a thermocouple 48 at the other end 40B which contains a pellet 42. The seal body 40 is then heated by means of the two electric furnaces 45, 47. After the pellet 42 in the seal body 40 is completely vaporized, one end 40A is cooled while the other end 40B remains heated. Using this method, the metal halide that is vaporized by heating within the seal body 40 expands from the end 40A into the end 40B. Because the temperature of the halogen-introduction carriers 25 in the end 40A of the seal body 40 is lower, the metal halide is absorbed by the halogen-introduction carrier 25. In this process, the amount of metal halide absorbed by the halogen-introduction carriers 25 can be ascertained by measuring the amount of halogen absorbed by any one of the several halogen-introduction carriers.

In the manufacturing process described above, the metal halide is absorbed by the porous body of the halogen-introduction carrier 25 in a roughly unimolecular layer. Therefore, by controlling the size of the halogen-introduction carrier 25, it is possible to regulate accurately the target amount of halogen introduced, even when the amount is very slight. Specifically, it is possible to absorb 1 $\mu$g of bromine in a halogen-introduction carrier that comprises porous body of tungsten 1.1 mm in outside diameter, 2 mm in length and 19 mg in weight. Moreover, because the metal halide absorbed in the halogen-introduction carrier 25 is released by heating, an accurately regulated amount of halogen can be introduced into the space 27, which will become the discharge space, by introducing an halogen-introduction carrier 25 of controlled size into the auxiliary tube 23, heating it to release the halogen, and letting the halogen expand into the space 27.

Moreover, the amount of halogen introduced into the space 27 that will become the discharge space can be adjusted by means of the temperature at which the halogen-introduction carrier 25 is heated or by means of the period of time it is heated. In this way, in the case of high-pressure mercury lamp with a discharge space 17 not exceeding 80 mm$^3$ it is possible to introduce, by an easy operation, the desired amount of halogen to an accuracy of ±20% of the target value. Thus, because the desired amount of halogen has been incorporated in the high-pressure mercury lamp produced, it is possible to obtain precisely the target luminous flux maintenance ratio. And because there is no light-spot shift due to wastage of the discharge electrode 14, or other inconveniences arising from the introduction of an excessive amount of halogen, it is also possible to obtain a high luminous flux maintenance ratio over a long period, and thus preserve good lighting conditions. Additionally, because the halogen is introduced using a metal halide, the high-pressure mercury lamp obtained has none of the carbon or hydrogen introduced into the discharge vessel 10 by the conventional method using methylene bromide. Therefore, it is possible to preserve good lighting conditions, without deterioration in the form of blackening or loss of transparency of the tube wall of the discharge vessel 10 that accompanies carbon and hydrogen.

In the event that the halogen-introduction carrier 25 is a porous body of tungsten, there is no danger of introducing impurities in the process of manufacturing the high-pressure mercury lamp, since the same material is used for the discharge electrode 14 that is used in the discharge space 17. Moreover, because the metal halide is a compound of bromine and mercury, the temperature at which adsorption and release occur during heating and cooling of the halogen-introduction carrier 25 is lower than if other compounds were used. It is possible, therefore, to perform easily the operations of adsorbing and releasing the metal halide.

Figure 5:
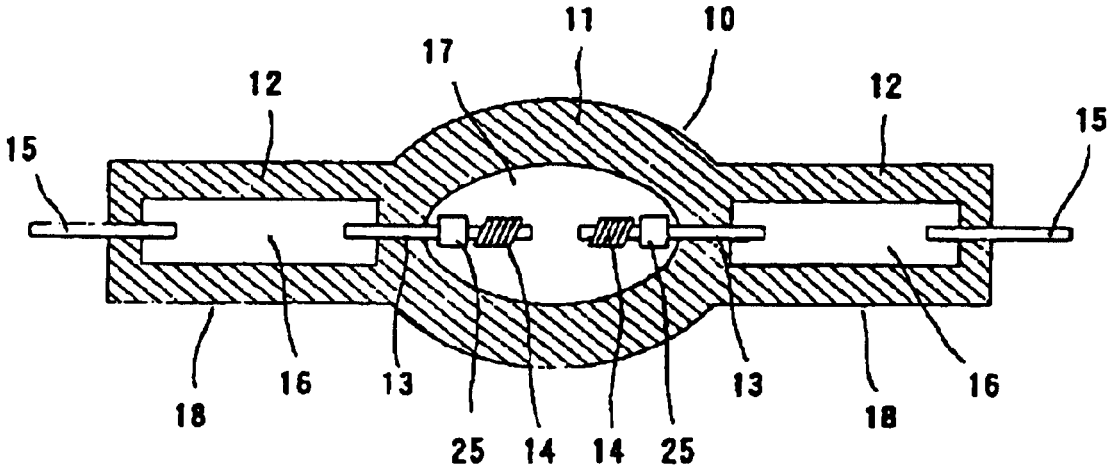
FIG. 5 is a cross-sectional view showing the structure of a high-pressure mercury lamp in accordance with a second embodiment of the present invention.

FIG. 5 is an explanatory cross section showing the structure of a high-pressure mercury lamp that is a second embodiment of the discharge lamp in accordance with the present invention. In this embodiment, the high-pressure mercury lamp has essentially the same structure as that shown in FIG. 1, except that a halogen-introduction carrier 25 in the form of a cylindrical porous body is mounted on the electrode bar 13, between the discharge electrode 14 and the metallic foil 16. Moreover, the halogen-introduction carrier 25 uses the same sort of porous body shown in the first embodiment. The high-pressure mercury lamp includes two electrode assemblies, with a discharge electrode formed on the tip of the electrode bar 13, a halogen-introduction carrier 25 mounted on the middle of the bar and one end of the metallic foil 16 connected to the far end of the bar, with the other end of the metallic foil 16 attached to the tip of the external lead bar. Thus, the high-pressure mercury lamp can be manufactured by a method similar to that in the first embodiment of the invention. The halogen-introduction carrier 25 in this assembly has adsorbed metal halides, and so can introduce halogen into the discharge vessel. In that case, the same operational effect is obtained as in the first embodiment of the invention.

An explanation of this invention has been given above, but it is possible to make various changes within the present invention. For example, the discharge lamp is not limited to high-pressure mercury lamps, and thus, metal halide lamps and other discharge lamps may also be included. In the first embodiment of the invention, a halogen-introduction carrier 25 recovered during the manufacture of one discharge lamp can again adsorb metal halides if heating and cooling cause a reversible release and adsorption, after which it is possible to reuse the halogen-introduction carrier 25 in the process of manufacturing a new discharge lamp. In other words, the halogen-introduction carrier 25 can be used effectively. In a second embodiment of the invention, the halogen-introduction carrier 25 can also be used to make up the discharge electrode of the discharge lamp.

During the manufacture of the halogen-introduction carrier, powdered tungsten with an average particle diameter of 5 $\mu$m was prepared by mixing with 5 wt-% stearic acid as a binder and heating, then loaded into a mold with columnar mold spaces and compacted with a press to form molded pieces measuring 1.1 mm in outside diameter, 2 mm total length, and 20 mg in weight. The molded pieces thus obtained were heated under a hydrogen atmosphere to produce pre-sinters, and the pre-sinters were sintered in a vacuum to produce halogen-introduction carriers which were columnar porous bodies. A metal halide composed of mercury bromide (HgBr2) was adsorbed by multiple manufactured halogen-introduction carriers, by the method shown in FIG. 4. When one of these halogen-introduction carriers 25 underwent quantitative measurement by means of ion chromatography, the adsorption of 1 $\mu$g of bromine was confirmed.

Using the above halogen-introduction carrier 25, a high-pressure mercury lamp with the structure shown in FIG. 1 was manufactured by the manufacturing method in accordance with the first embodiment of the present invention. Specifically, a seal tube 20 was manufactured with a halogen-introduction carrier 25 placed in the auxiliary tube 23, with the structure shown in FIG. 2. Then, the halogen-introduction carrier 25 was heated at 600° C. for fifteen minutes from outside the auxiliary tube 23 of the seal tube 20, after which the auxiliary tube 23 was removed and the halogen-introduction carrier 25 was recovered. In this way, a high-pressure mercury lamp was manufactured incorporating the target amount of $2.5\times10^{-4}$ $\mu$mol/mm$^3$ of bromine. The high-pressure mercury lamp was lighted continuously; after three thousand hours no darkening or loss of transparency of the tube wall of the discharge vessel had occurred, and there had been on light-spot shift.

A halogen in the form of methylene bromide was incorporated in the discharge vessel of a high-pressure mercury lamp with the same specifications as in the first test case and was lighted continuously. At three thousand hours, darkening and loss of transparency of the tube wall of the discharge vessel were confirmed. Under the manufacturing method of the present invention, halogen is introduced from a halogen-introduction carrier that includes a porous body that has adsorbed metal halides in a roughly unimolecular layer, and so by controlling the amount of the halogen-introduction carrier used for introduction, it is possible to regulate accurately the amount of halogen introduced, even when it is a very slight amount. Moreover, introduction of that amount of halogen is a very easy operation. In addition, because the halogen is introduced via a metal halide, no carbon or hydrogen is introduced into the discharge vessel along with the halogen.

With the discharge lamp of the present invention, the desired amount of halogen is sealed into a discharge vessel with a discharge space of small volume, and so it is possible to obtain precisely the target luminous flux maintenance ratio. It is also possible to prevent undesirable phenomena such as light-spot shift due to wastage of the discharge electrodes as a result of an excessive amount of halogen. In addition, no carbon or hydrogen is introduced into the discharge vessel, and thus, there is no blackening or loss of transparency of the tube wall of the discharge vessel.

The halogen-introduction carrier of the present invention is preferably a porous body of tungsten and has a relatively large specific surface. Moreover, the halogen-introduction carrier adsorbs metal halides in a roughly unimolecular layer, and thus, by controlling the amount of halogen-introduction carrier used, it is possible to regulate accurately the amount of halogen introduced, even when it is a very low amount.

What is claimed is:

1. A method of manufacturing discharge lamps comprising the steps of:

providing a discharge vessel that defines a light emitting discharge space; and introducing a predetermined amount of halogen into said discharge space, wherein said predetermined amount of halogen is introduced into said discharge vessel by heating at least one halogen-introduction carrier composed of a porous body of sintered tungsten containing an adsorbed metal halide in the form of mercury bromide ($HgBr_2$).

2. The method of manufacturing discharge lamps as described in claim 1, wherein said at least one halogen-introduction carrier is located inside said discharge vessel and is heated from an outside source.

3. The method of manufacturing discharge lamps as described in claim 2, wherein said discharge vessel includes a main tube and first and second elongated seal tube sections extending from opposite ends of said main tube;

wherein electrode bars are positioned extending into said discharge space; and wherein said at least one halogen-introduction carrier is mounted on at least one of said electrode bars within said discharge space.

4. The method of manufacturing discharge lamps as described in claim 1, wherein said discharge vessel includes a main tube and first and second elongated seal tube sections extending from opposite ends of said main tube;

wherein an auxiliary tube is connected to an outer end of one of the seal tube sections;

wherein said halogen-introduction carrier is disposed in said auxiliary tube;

wherein said halogen-introduction carrier is recovered by removal of said auxiliary tube after release of the metal halide and sealing of the seal tube section to which the auxiliary tube is connected; and then extracting the carrier from the auxiliary tube for re-adsorption with a metal halide and subsequent reuse.

5. A method of manufacturing discharge lamps as described in claim 1, wherein said halogen-introduction carrier is a porous body composed of sintered tungsten having a density from 8 to 13 g/cm$^3$.

6. A method of manufacturing discharge lamps as described in claim 3, wherein said discharge space has a volume of at most 80 mm$^3$ and the predetermined amount of halogen is between $1.7\times10^{-4}$ and $6.7\times10^{-4}$ $\mu$mol/mm$^3$.

* * * * *